US005342061A

United States Patent [19]

Watts, III

[11] Patent Number: 5,342,061

[45] Date of Patent: Aug. 30, 1994

[54] SIMULATED BASEBALL GAME

[76] Inventor: Eudell Watts, III, 9101 33rd St. West, Rock Island, Ill. 61201

[21] Appl. No.: 99,904

[22] Filed: Jul. 19, 1993

[51] Int. Cl.[5] ..... A63B 67/00

[52] U.S. Cl. ..... 273/341; 273/58 F; 273/428; 273/DIG. 20

[58] Field of Search ..... 273/341, 411, 58 G, 273/58 F, DIG. 20, 428

[56] References Cited

U.S. PATENT DOCUMENTS

| | | | |
|---|---|---|---|
| 672,478 | 4/1901 | Gednex | 273/341 |
| 2,683,603 | 7/1954 | Gackenbach | 273/428 |
| 3,073,598 | 1/1963 | Tiikainen | 273/341 |
| 3,528,661 | 9/1970 | Warner | 273/93 C |
| 3,554,551 | 1/1971 | Apiki | 273/411 |
| 3,990,699 | 11/1976 | Urmston | 273/67 B |
| 4,093,226 | 6/1978 | Priestle | 273/341 |
| 4,291,879 | 9/1981 | Nagato | 273/119 R |
| 4,317,571 | 3/1982 | Vrcic | 273/341 |
| 4,941,662 | 7/1990 | Deperna | 273/25 |

*Primary Examiner*—William H. Grieb

[57] ABSTRACT

A new and improved simulated baseball game includes a projectile assembly which includes an end portion and a middle portion. The middle portion includes a substantially constant height, and the end portion includes a variable height decreasing in a distal direction from the middle portion. A bat is used for hitting the projectile assembly. The end portion and the middle portion join together at a fulcrum. The end portion forms a first lever arm adjacent to the fulcrum, and the middle portion forms a second lever arm adjacent to the fulcrum. A number of markers are provided for indicating respective specific accomplishments relating to baseball. The markers are positioned on a region of a ground surface in front of a home plate region where the projectile assembly is launched by the bat. A removable and replaceable weight assembly may be located in interior portion of the projectile assembly. The weight assembly may include a cylindrical metal tube element. The weight assembly may include a separable housing which includes a plurality of shiftable weight members. The shiftable weight members include metal balls. A new and improved a projectile assembly includes an end portion, and a middle portion. The middle portion includes a substantially constant height, and the end portion includes a variable height decreasing in a distal direction from the middle portion.

7 Claims, 6 Drawing Sheets

SIMULATED BASEBALL GAME

BACKGROUND OF THE INVENTION

1. Field of the Invention

The present invention relates generally to the game of baseball and, more particularly, to a simulated baseball game.

2. Description of the Prior Art

The game of baseball is a popular game in the United States and in many other countries of the world. To play the actual game of baseball, a large amount of land must be set aside for a baseball field. The land must be well tended to provide a diamond for the infield and well mown grass for the outfield. A minimum of eighteen players are involved, nine on each opposing team. Because of such burdensome requirements relating to land use and personnel numbers for playing an actual game of baseball, it has been deemed desirable to provide simulations of the game of baseball that are less burdensome with respect to land use and personnel requirements than the actual game of baseball.

Throughout the years, a number of innovations have been developed relating to simulations of the game of baseball. The so called sandlot games are simulations that require less space and less personnel. Yet, even with sandlot games, two opposing teams are necessary, and a considerable amount of land is still required, even for a sandlot game. In this respect, it would be desirable if a simulated baseball game were provided that did not require as much land as a sandlot game and did not require an opposing team as does a sandlot game.

Additional innovations relating to simulated baseball games have been developed, and the following U.S. Pat. Nos. are representative of some of those innovations: 3,528,661; 3,990,699; 4,291,879; 4,317,571; and 4,941,662. More specifically, U.S. Pat. Nos. 3,528,661 and 4,291,879 disclose board games that simulate the game of baseball. An undesirable feature of a board game is that it does not permit a player to hold and swing an actual bat and obtain the exercise and satisfaction from actually swinging a bat and hitting a projectile. In this respect, it would be desirable if a simulated baseball game were provided which enabled a player to swing a bat and hit a projectile therewith.

U.S. Pat. No. 3,990,699 discloses a novel bat which fits over the hand and arm of a player. This bat is held on one hand. Therefore, this bat does not permit a player to hold a conventional bat and swing it in a conventional way to hit a projectile. In this respect, it would be desirable if a simulated baseball game were provided which enabled a player to hold a conventional bat and swing it in a conventional way to play the simulated game.

U.S. Pat. No. 4,317,571 discloses a bat and projectile game in which a projectile is placed in a groove of base, and the projectile is launched upwardly by striking the exposed portion of the projectile with a bat. This game launches a projectile with a swinging motion that is more likened to the game of golf than to the game of baseball. In baseball, the swinging motion is substantially horizontal. In the game disclosed in this patent and in golf, the swinging motion for hitting the projectile away from the player is primarily vertical. In this respect, it would be desirable if a simulated baseball game were provided in which the swinging motion of the bat in hitting the projectile away from the player is primarily a horizontal swinging motion.

U.S. Pat. No. 4,941,662 discloses a simulated baseball game which employs a complex of spatial zones which include sensors for detecting the presence of a hit ball in the respective zones. This is a complex electronic system that requires a relative large three dimensional space in which play takes place. In this respect, it would be desirable if a simulated baseball game were provided which did not require complex electronics for playing the game.

Still other features would be desirable in a simulated baseball game. For example, in a real game of baseball there is an opposing pitcher who pitches to a batter. The opposing pitcher may have a variety of pitches to choose from including a fast ball, a curve ball, a slider, a knuckle ball, etc.. The batter never knows for sure what pitch the pitcher will pitch, and the batter must be alert and adaptable to any pitch that is pitched. In this respect, it would be desirable if a simulated baseball game were provided which presented the batter with a variety of unpredictable simulated pitches.

Another desirable feature in a simulated baseball game includes the use of readily deployable elements which indicate simulated occurrences of aspects of baseball play which include a single, a double, a triple, a home run, etc.

The game of baseball is played by persons of all ages and sizes. In this respect, it would be desirable if a simulated baseball game were provided that were adaptable to be played by persons spanning a wide range of ages and sizes.

In the real game of baseball, the baseball field has foul lines which radiate from the home plate as radii of a circle. In addition, there are circumferential arcs on the field that represent portions of circles that have the home plate as the center of the circles. The outer margin of the infield is like one arc. The outer boundary of the outfield is like an outer are. In this respect, it would be desirable if a simulated baseball game were provided that dispensed with the need for radial foul lines and circumferential infield margins and outfield boundaries on the playing field.

In the actual game of baseball, a number of distinct skills are required which include: batting; running; catching; and throwing. For many people, batting is the most desirable feature of baseball when they actually participate in the game as opposed to just being a spectator. The prevalence of commercial batting cages that are open to the public attest to the general love of batting. In this respect, it would be desirable if a simulated baseball game were provided which emphasized the skill of batting and deemphasized the skills of running, catching, and throwing.

Just as in an actual game of baseball, in a simulated game of baseball, scoring is important to some people to satisfy their competitive spirit. In this respect, it would be desirable if a simulated baseball game were provided which included an easy to learn scoring system.

Thus, while the foregoing body of prior art indicates it to be well known to have simulated baseball games, the prior art described above does not teach or suggest a simulated baseball game which has the following combination of desirable features: (1) provides simulations of the game of baseball that are less burdensome with respect to land use and personnel requirements than the actual game of baseball; (2) does not require as much land as a sandlot game and does not require an opposing team as does a sandlot game; (3) enables a player to swing a bat and hit a projectile therewith; (4) enables a player to hold a conventional bat and swing it in a conventional way to play the simulated game; (5) allows for a primarily horizontal swinging motion of the bat in hitting the projectile away from the player; (6) does not require complex electronics for playing the game; (7) presents the batter with a variety of unpredictable simulated pitches; (8) uses readily deployable elements which indicate simulated occurrences of aspects of baseball play which include a single, a double, a triple, a home run, etc; (9) is adaptable to be played by persons spanning a wide range of ages and sizes; (10) dispenses with the need for radial foul lines and circumferential infield margins and outfield boundaries on the playing field; (11) emphasizes the skill of batting and deemphasizes the skills of running, catching, and throwing; and (12) includes an easy to learn scoring system. The foregoing desired characteristics are provided by the unique simulated baseball game of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved simulated baseball game which includes a projectile assembly which includes an end portion and a middle portion. The middle portion includes a substantially constant height, and the end portion includes a variable height decreasing in a distal direction from the middle portion. A bat is used for hitting the projectile assembly. The end portion and the middle portion join together at a fulcrum. The end portion forms a first lever arm adjacent to the fulcrum, and the middle portion forms a second lever arm adjacent to the fulcrum.

A number of markers are provided for indicating respective specific accomplishments relating to baseball. The markers are positioned on a region of a ground surface in front of a home plate region where the projectile assembly is launched by the bat.

A removable and replaceable weight assembly may be located in interior portion of the projectile assembly. The weight assembly may include a cylindrical metal tube element.

The weight assembly may include a separable housing which includes a plurality of shiftable weight members. The shiftable weight members include metal balls.

A new and improved a projectile assembly includes an end portion, and a middle portion. The middle portion includes a substantially constant height, and the end portion includes a variable height decreasing in a distal direction from the middle portion.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved simulated baseball game which has all of the advantages of the prior art and none of the disadvantages.

It is another object of the present invention to provide a new and improved simulated baseball game which may be easily and efficiently manufactured and marketed.

It is a further object of the present invention to provide a new and improved simulated baseball game which is of durable and reliable construction.

An even further object of the present invention is to provide a new and improved simulated baseball game which is susceptible of a low cost of manufacture with regard to both materials and labor, and which accordingly is then susceptible of low prices of sale to the consuming public, thereby making such simulated baseball game available to the buying public.

Still yet a further object of the present invention is to provide a new and improved simulated baseball game which provides simulations of the game of baseball that are less burdensome with respect to land use and personnel requirements than the actual game of baseball.

Still another object of the present invention is to provide a new and improved simulated baseball game that does not require as much land as a sandlot game and does not require an opposing team as does a sandlot game.

Yet another object of the present invention is to provide a new and improved simulated baseball game which enables a player to swing a bat and hit a projectile therewith.

Even another object of the present invention is to provide a new and improved simulated baseball game that enables a player to hold a conventional bat and swing it in a conventional way to play the simulated game.

Still a further object of the present invention is to provide a new and improved simulated baseball game which allows for a primarily horizontal swinging motion of the bat in hitting the projectile away from the player.

Yet another object of the present invention is to provide a new and improved simulated baseball game that does not require complex electronics for playing the game.

Still another object of the present invention is to provide a new and improved simulated baseball game which presents the batter with a variety of unpredictable simulated pitches.

An even further object of the present invention is to provide a new and improved simulated baseball game that uses readily deployable elements which indicate simulated occurrences of aspects of baseball play which include a single, a double, a triple, a home run, etc.

Still a further object of the present invention is to provide a new and improved simulated baseball game that is adaptable to be played by persons spanning a wide range of ages and sizes.

Yet another object of the present invention is to provide a new and improved simulated baseball game which dispenses with the need for radial foul lines and circumferential infield margins and outfield boundaries on the playing field.

Still another object of the present invention is to provide a new and improved simulated baseball game that emphasizes the skill of batting and deemphasizes the skills of running, catching, and throwing.

Yet another object of the present invention is to provide a new and improved simulated baseball game which includes an easy to learn scoring system.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 2:
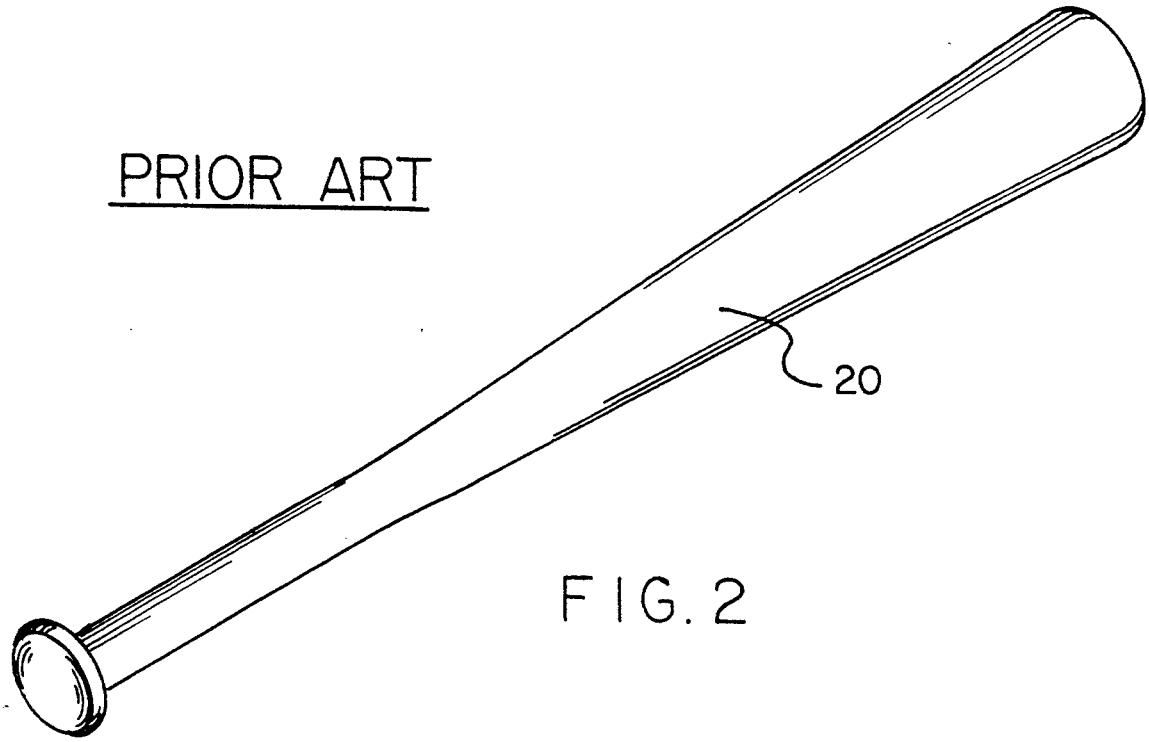
FIG. 2 is a perspective view of a conventional prior art bat used in the simulated baseball game of the invention.
Figure 1:
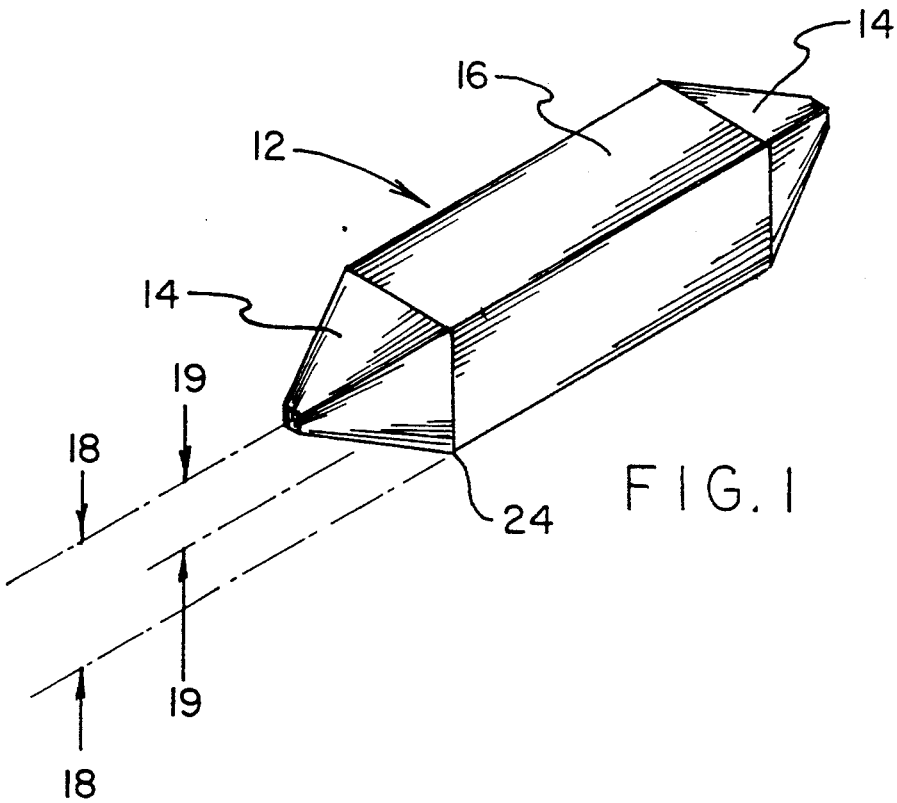
FIG. 1 is a perspective view showing a first preferred embodiment of a novel projectile used in the simulated baseball game of the invention.

With reference to the drawings, a new and improved simulated baseball game embodying the principles and concepts of the present invention will be described.

Turning initially to FIGS. 1–6, there is shown a first exemplary embodiment of the simulated baseball game of the invention and the steps in using the invention. In its preferred form, simulated baseball game 10 includes a new and improved simulated baseball game includes a projectile assembly 12 which includes a pair of opposed end portions 14 and a middle portion 16. The middle portion 16 includes a substantially constant height 18, and each end portion 14 includes a variable height 19 decreasing in a distal direction from the middle portion 16. A bat 20 is used for hitting the projectile assembly 12. In common parlance, each end portion 14 is tapered to a point. The bat 20 can be a conventional bat such as used in a real baseball game. Alternatively, the bat can be a special lightweight bat. Each end portion 14 and the middle portion 16 join together at a fulcrum 24. Each end portion 14 forms a first lever arm adjacent to the fulcrum 24, and the middle portion 16 forms a second lever arm adjacent to the fulcrum 24.

Figure 3:
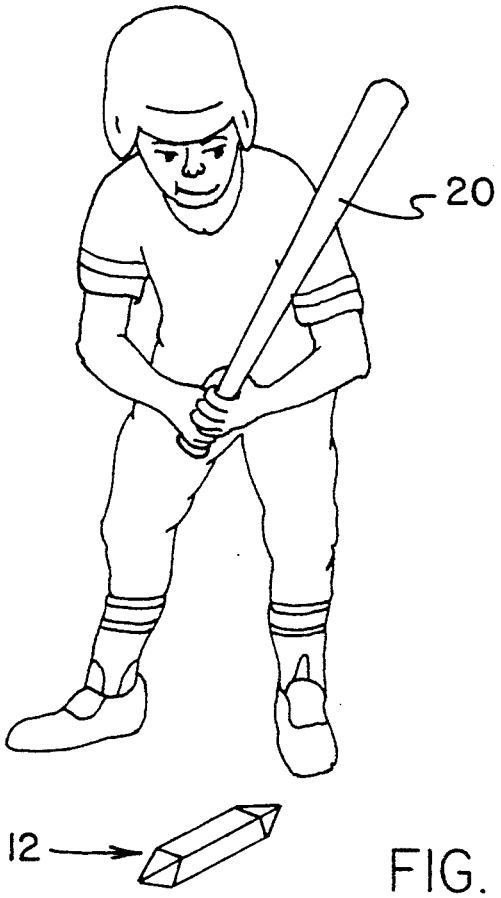
FIG. 3 is a perspective view of a player of the simulated baseball game of the invention preparing to launch the projectile shown in FIG. 1.
Figure 4:
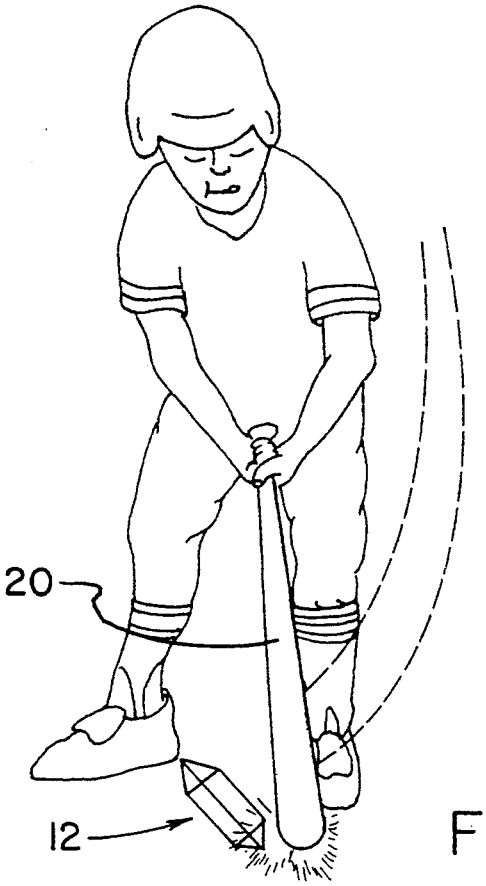
FIG. 4 is a perspective view of the player in FIG. 3 contacting the projectile of the invention for launching it.
Figure 5:
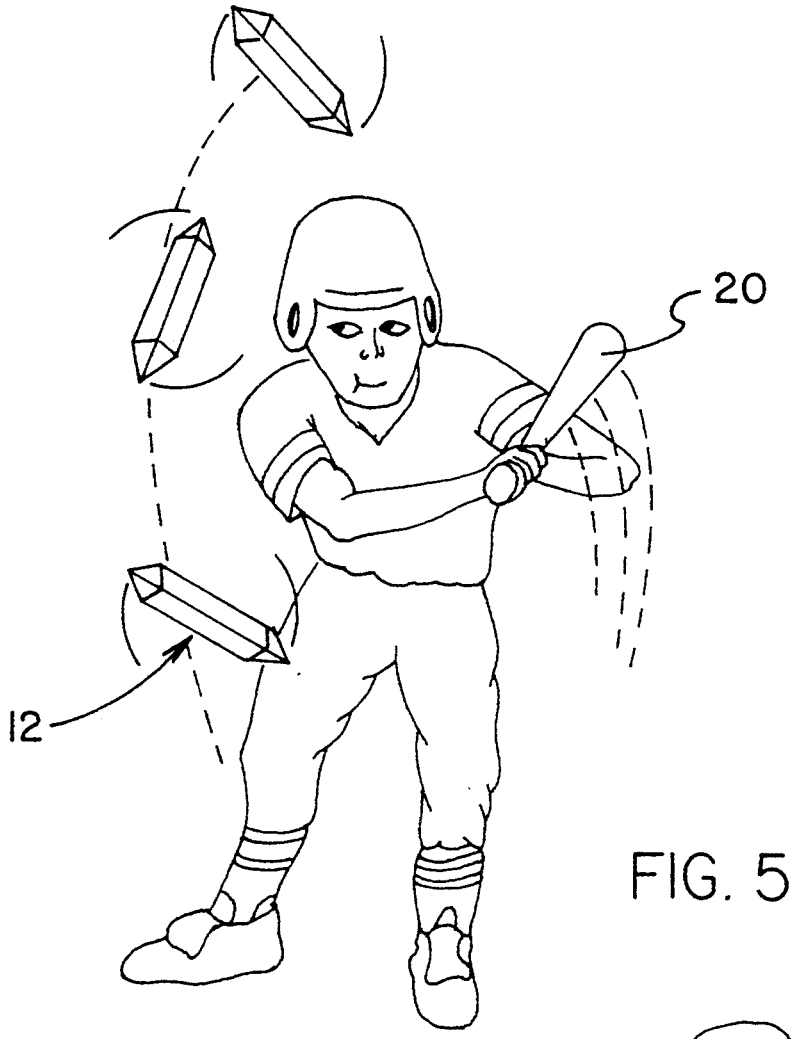
FIG. 5 is a perspective view of the launched projectile and the path of the projectile over a period of time, wherein the player is preparing to take a swing at the projectile.
Figure 6:
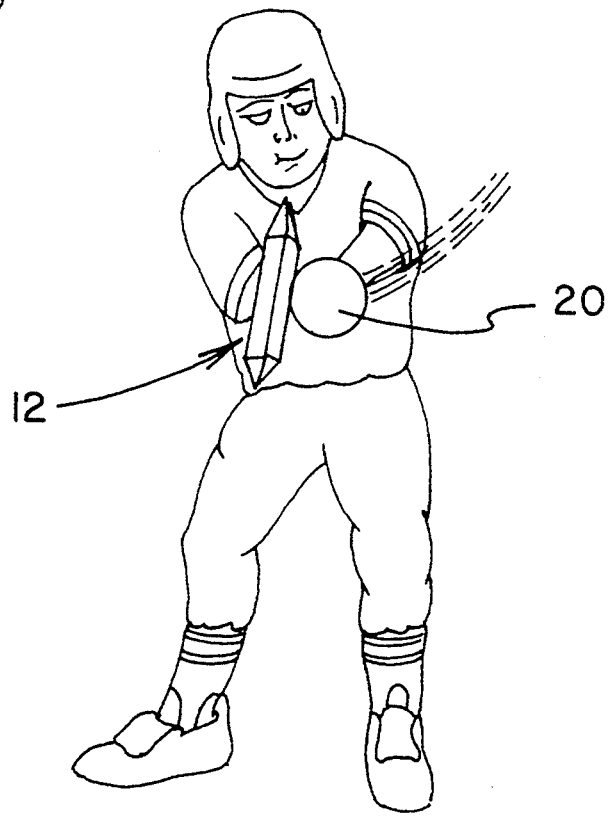
FIG. 6 is a perspective view of the player swinging the bat and making a hitting contact with the projectile.

In operation, by placing a projectile assembly 12 on the ground (as shown in FIG. 3), by taking the bat 20, and by hitting one of the end portions 14 in a vertically striking manner (as shown in FIG. 4), the force of hitting on the end portion 14 causes the variable height end portion 14 to be pushed closer to the ground. As in a teeter totter or seesaw, when the end portion 14 is pushed closer to the ground, the middle portion 16 rises up above the ground around the fulcrum 24. More specifically. A sharp striking force on the end portion 14, causes the middle portion 16 to rise so abruptly and with such force that the projectile assembly 12 is launched into the air (as shown in FIG. 5). As the projectile assembly 12 is rising in the air, it is also rotating around its center of gravity. Also, the player cocks the bat 20 in preparation for swinging the bat 20 to hit the projectile assembly 12. Shortly, the projectile assembly 12 reaches the apex of its trajectory and then begins to fall back toward the ground. When the player deems it the appropriate time, the player swings the bat 20 in a primarily horizontal swing and hits the projectile assembly 12 (as shown in FIG. 6).

Figure 7:
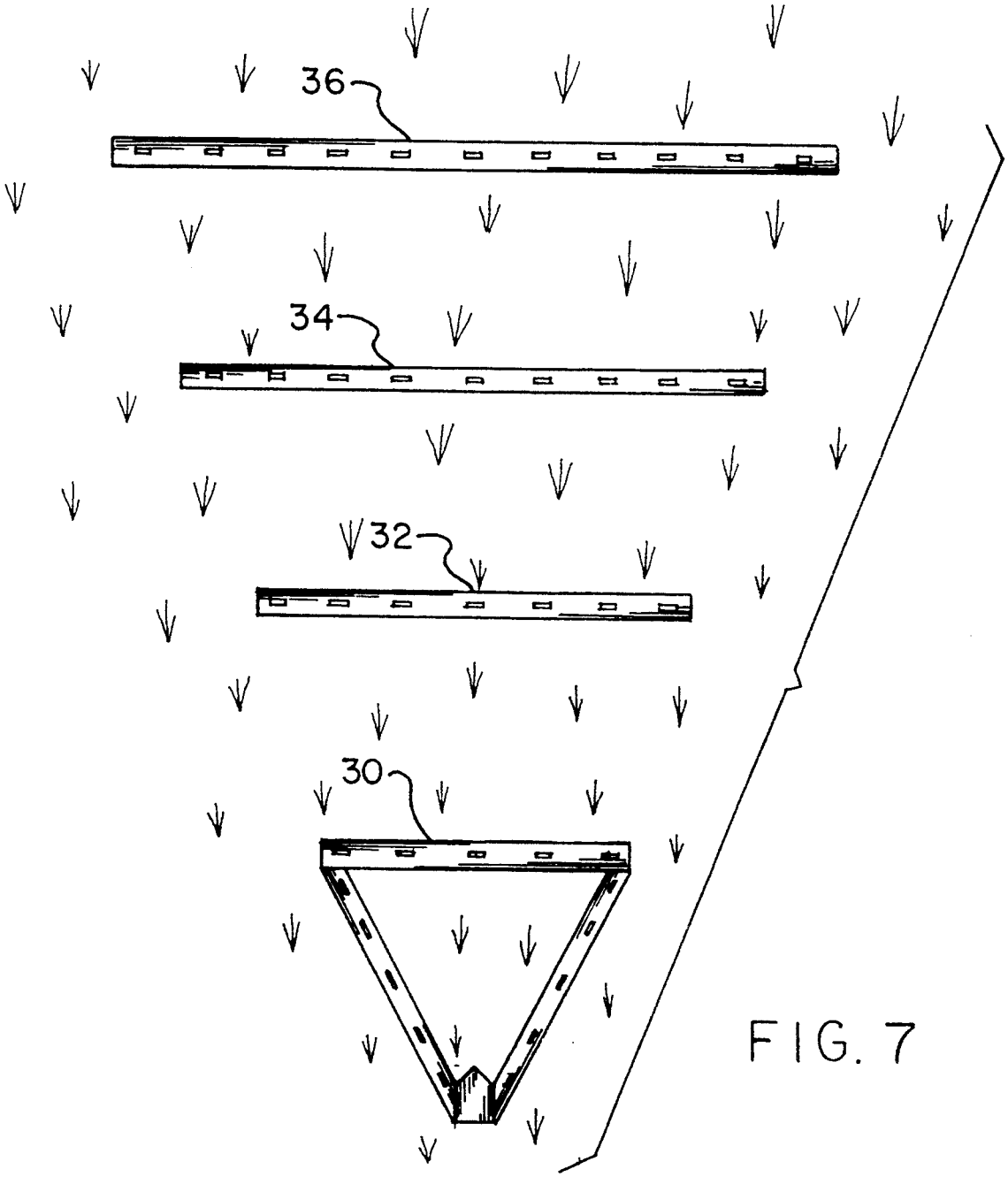
FIG. 7 is an array of field marking elements for marking types of hits.

Turning to FIG. 7 an additional feature of the invention is shown. A number of markers are provided for indicating respective specific accomplishments relating to baseball. The markers are positioned on a region of a ground surface 28 in front of a home plate region where the projectile assembly 12 is launched by the bat 20. A first marker 30 indicates a single. A second marker 32 indicates a double. A third marker 34 indicates a triple. A fourth marker 36 indicates a home run.

Figures 8, 9, 10:
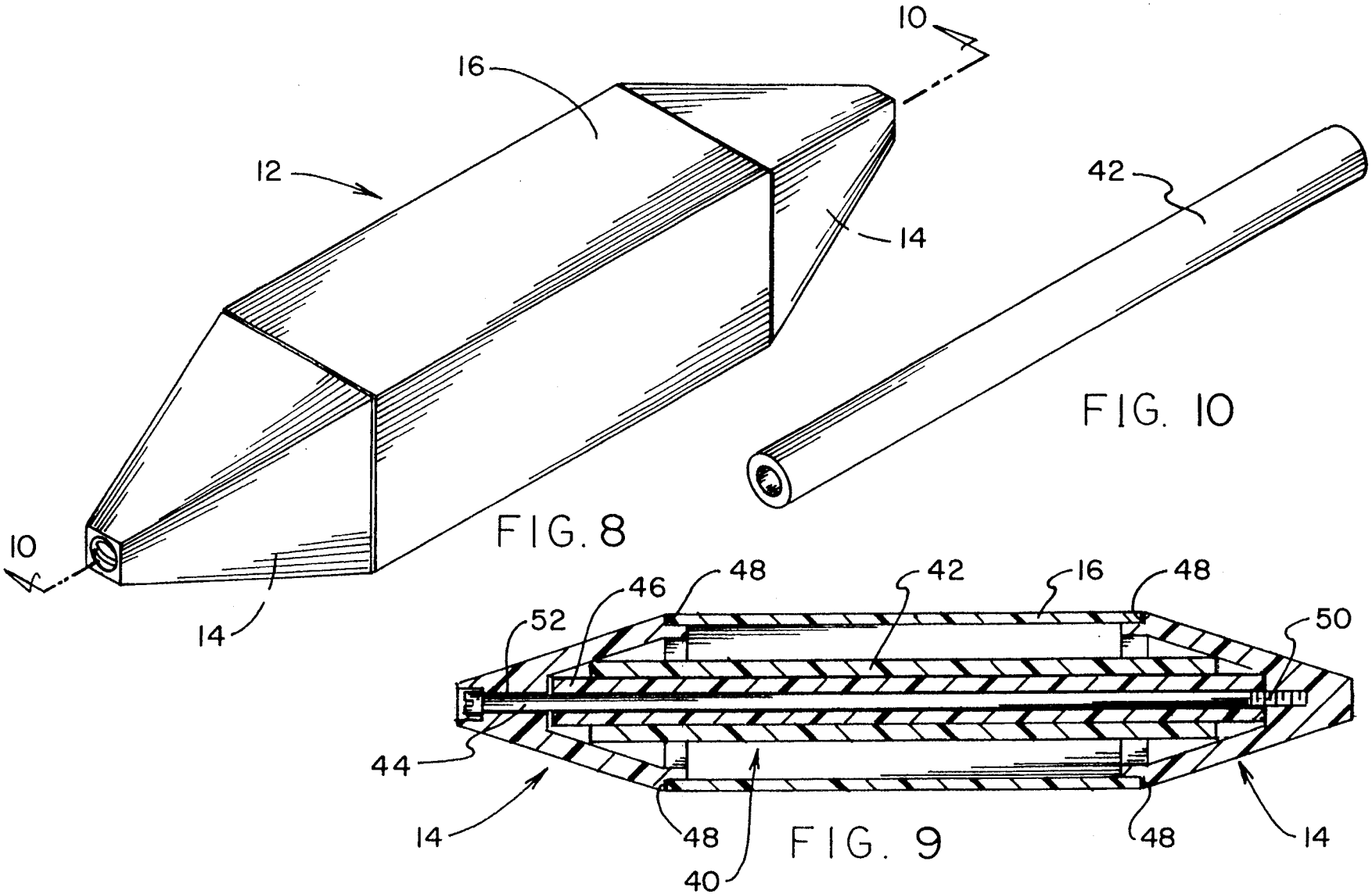
FIG. 8 is a perspective view of a second embodiment of a projectile of the simulated baseball game of the invention.
FIG. 9 is a cross-sectional view of the embodiment of the projectile shown in FIG. 8 taken along the line 10—10 thereof.
FIG. 10 is a perspective view of a removable and replaceable weight element found inside the embodiment of the projectile shown in FIG. 9.

Turning to FIGS. 8–10, a second embodiment of the projectile assembly 12 of the invention is shown. Reference numerals are shown that correspond to like reference numerals that designate like elements shown in the other figures. In addition, a removable and replaceable weight assembly 40 is located in interior portion of the projectile assembly 12. The weight assembly 40 includes a cylindrical metal tube element 42. The tube element 42 is located in the interior of the projectile assembly 12 which serves as a housing for the tube element 42. The weight assembly 40 also includes elements for keeping the tube element 42 in position inside the projectile assembly 12. More specifically, the weight assembly 40 includes a locking rod 44 and a spacer sleeve 46 located on the locking rod 44.

In this embodiment of the projectile assembly 12, the respective end portions 14 are in the form of separable caps for a hollow middle portion 16. The end caps 14 are retained on the middle portion 16 by respective L-shaped flanges 48 on the respective end portions 14. One of the end caps 14 has a threaded portion for receiving a complementary threaded end 50 on the locking rod 44. The other of the end caps 14 has an aperture 52 for receiving the locking rod 44 as it passes through the spacer sleeve 46 which is jacketed by the tube element 42, which, in turn, is jacketed by the middle portion 16. The projectile assembly 12 in FIGS. 9–10 can be readily disassembled for removal and replacement of the tube element 42. Then, the projectile assembly 12 can readily be reassembled.

Figure 12:
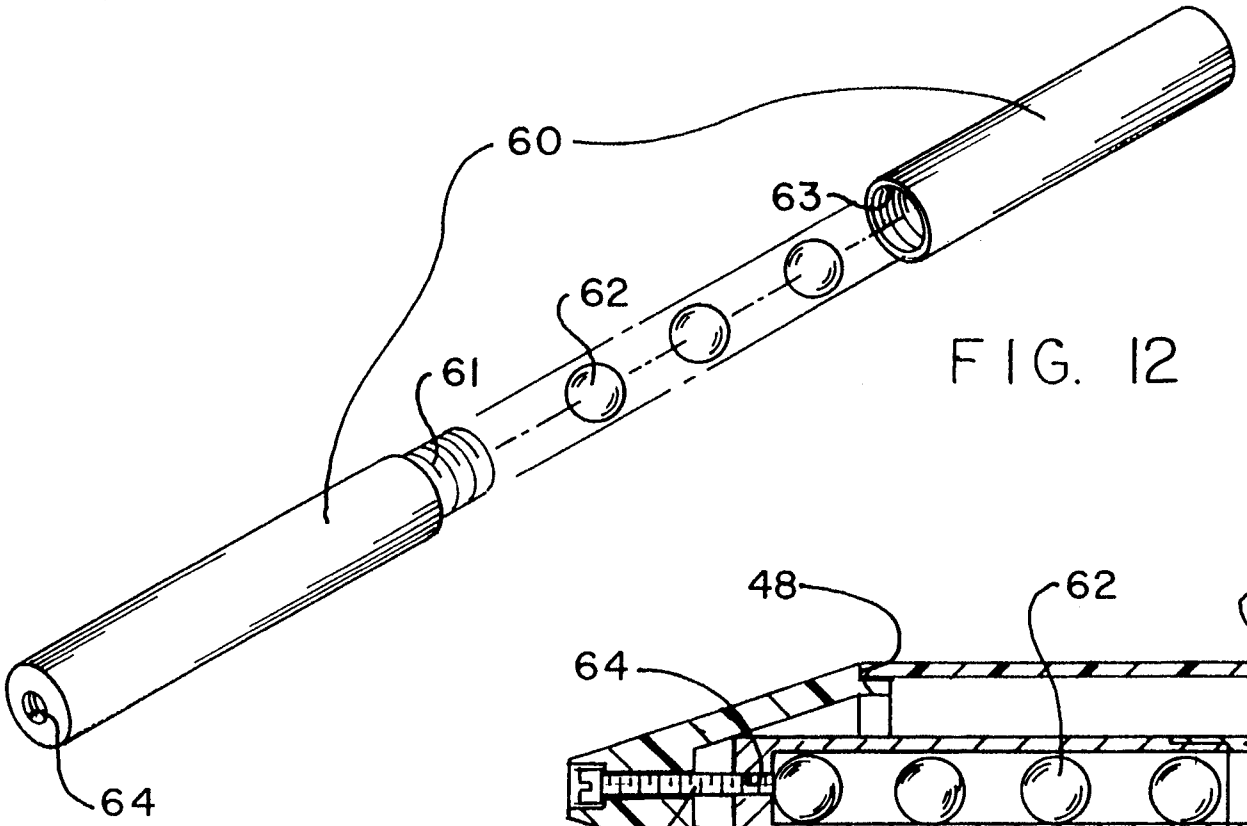
FIG. 12 is an exploded, perspective view of the shiftable weight unit of the projectile shown in FIG. 11.
Figure 11:
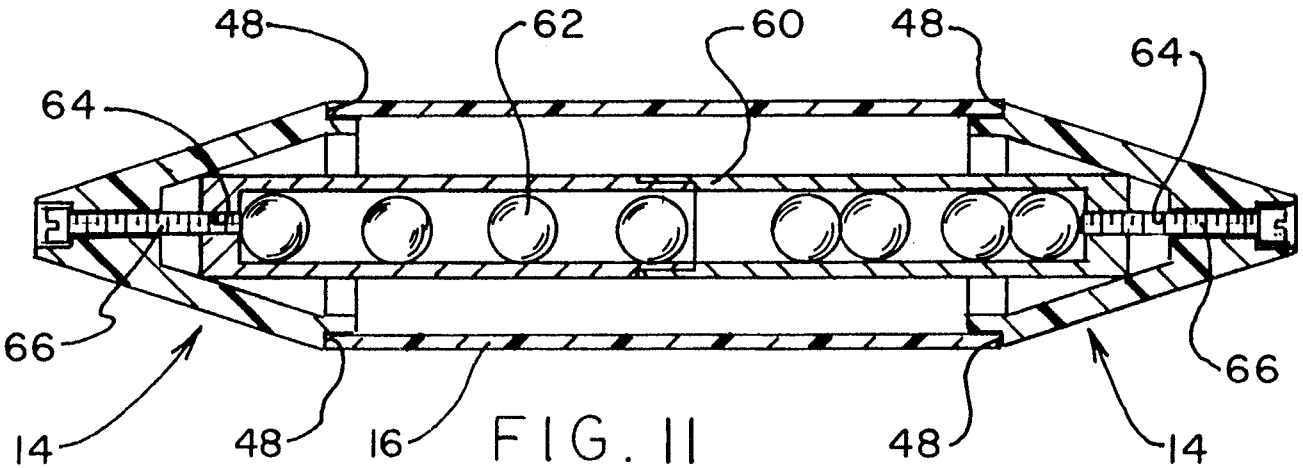
FIG. 11 is cross-sectional view of a third embodiment of the projectile of the simulated baseball game of the invention in which a weight unit has a plurality of shiftable weight components.

Turning to FIGS. 12–13, a third embodiment of the projectile assembly 12 of the invention is shown. Reference numerals are shown that correspond to like reference numerals that designate like elements shown in the other figures. In addition, the weight assembly 40 includes a separable housing 60 which includes a plurality of shiftable weight members 62. The respective members of the separable housing 60 have respective complimentary threads 61 and 63.

In operation, when the projectile assembly 12 is hit by the bat 20 and the projectile assembly 12 is launched as shown in FIGS. 4–6, the random and unpredictable shifting of the shiftable weight members 62 imparts a random and unpredictable motion to the projectile assembly 12. This random and unpredictable motion provides a simulated variety of simulated pitches. The shiftable weight members 62 include metal balls. Each element of the separable housing 60 includes a respective threaded aperture 64 for receiving a respective locking screw 66;

The simulated baseball game of the invention can be used in a variety of ways. For example, the batter may be given four projectile assemblies 12 of different colors. The markers are placed at predetermined locations on the ground surface 28. The batter begins by hitting the first projectile assembly 12. A single is worth twenty-five points. A double is worth fifty points. A triple is worth seventy-five points. A home run is worth one hundred points. A foul ball is an out. A hit not reaching the playing field is an out. Three strikes are an out. The first person to reach five hundred points wins the game. A fourth projectile assembly 12 may be designated as a chance attempt. Using the chance attempt requires the batter to acknowledge the number of points he or she is chancing. The batter must hit into that zone or beyond in order to avoid a penalty equivalent to the number of points attempted.

In a second method of play, the batter is given four projectile assemblies 12 to hit. A hit such as a single, double, triple, or home run advances an imaginary runner. The next hit advances the imaginary runner, but that hit does not result in a second imaginary runner. Only one imaginary runner is on the base path at a given time. Here are some more examples. A single followed by a triple scores a run. A single followed by another single puts the player with an imaginary runner on second base only. A triple followed by a single scores one run. A single followed by three more singles scores one run. In playing the game, a scratch pad would be convenient for keeping score.

The components of the simulated baseball game of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved simulated baseball game that is low in cost, relatively simple in design and operation, and which may advantageously be used to provide simulations of the game of baseball that are less burdensome with respect to land use and personnel requirements than the actual game of baseball. With the invention, a simulated baseball game is provided which does not require as much land as a sandlot game and does not require an opposing team as does a sandlot game. With the invention, a simulated baseball game is provided which enables a player to swing a bat and hit a projectile therewith. With the invention, a simulated baseball game is provided which enables a player to hold a conventional bat and swing it in a conventional way to play the simulated game. With the invention, a simulated baseball game is provided which allows for a primarily horizontal swinging motion of the bat in hitting the projectile away from the player. With the invention, a simulated baseball game is provided which does not require complex electronics for playing the game. With the invention, a simulated baseball game is provided which presents the batter with a variety of unpredictable simulated pitches. With the invention, a simulated baseball game is provided which uses readily deployable elements which indicate simulated occurrences of aspects of baseball play which include a single, a double, a triple, a home run, etc. With the invention, a simulated baseball game is provided which is adaptable to be played by persons spanning a wide range of ages and sizes. With the invention, a simulated baseball game is provided which dispenses with the need for radial foul lines and circumferential infield margins and outfield boundaries on the playing field. With the invention, a simulated baseball game is provided which emphasizes the skill of batting and deemphasizes the skills of running, catching, and throwing. With the invention, a simulated baseball game is provided which includes an easy to learn scoring system.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. For use in a new and improved simulated baseball game, comprising:

a projectile assembly, said projectile assembly adapted to be hit by a baseball bat and including at least one end portion and a middle portion, said middle portion including a substantially constant height, and said at least one end portion including a variable height decreasing in a distal direction from said middle portion, further including:

a removable and replaceable weight assembly located in an interior portion of said projectile assembly.

2. The apparatus described in claim 1 wherein said end portion and said middle portion join together at a fulcrum.

3. The apparatus described in claim 2 wherein:

said end portion forms a first lever arm adjacent to said fulcrum, and said middle portion forms a second lever arm adjacent to said fulcrum.

4. The apparatus described in claim 1, further including:

a number of markers for indicating respective specific achievements relating to baseball, wherein the markers are positioned on a region of a ground surface in front of a home plate region where said projectile assembly is launched by said bat.

5. The apparatus described in claim 1 wherein said weight assembly includes a cylindrical metal tube element.

6. The apparatus described in claim 1 wherein said weight assembly includes:

a separable housing which includes a plurality of shiftable weight members.

7. The apparatus described in claim 6 wherein said shiftable weight members include metal balls.

* * * * *